US005233736A

United States Patent [19]

Hill

[11] Patent Number: 5,233,736

[45] Date of Patent: Aug. 10, 1993

[54] APPARATUS AND PROCESS FOR CRIMPING AND CROSSLINKING FIBERS

[75] Inventor: Collin Hill, Chesire, Wash.

[73] Assignee: R.K. Carbon Fibers, Ltd., Scotland, United Kingdom

[21] Appl. No.: 967,450

[22] Filed: Oct. 28, 1992

[51] Int. Cl.[5] ..... D02G 1/20

[52] U.S. Cl. ..... 28/265; 28/221

[58] Field of Search ..... 28/221, 263, 265, 266

[56] References Cited

U.S. PATENT DOCUMENTS

| | | | |
|---|---|---|---|
| 3,413,697 | 12/1968 | Agett et al. | 28/265 X |
| 3,500,518 | 3/1970 | Stanley et al. | 28/265 |
| 3,719,976 | 3/1973 | Izawa et al. | 28/265 |
| 3,961,401 | 6/1976 | Ferrier et al. | 28/265 X |
| 3,965,547 | 6/1976 | Ferrier et al. | 28/265 X |
| 4,247,270 | 1/1981 | Schubert | 28/221 X |
| 4,912,821 | 4/1990 | Mutsuo | 28/221 X |

FOREIGN PATENT DOCUMENTS

| | | | |
|---|---|---|---|
| 871420 | 5/1971 | Canada | 28/221 |
| 0088245 | 9/1983 | European Pat. Off. | 28/266 |
| 9001578 | 2/1990 | World Int. Prop. O. | 28/221 |

*Primary Examiner*—Clifford D. Crowder
*Assistant Examiner*—John J. Calvert
*Attorney, Agent, or Firm*—John Lezdey

[57] ABSTRACT

An apparatus and process for providing crosslinked fibers or tows with non-symmetrical crimps. The process requires preheating precursor fibers or tows so as to soften the fibers prior to passing the fibers or tows through a horizontal stuffer crimper box to impart a crimp. The crimped fiber is then passed through a heating zone without stress or tension whereby the fibers or tows are carbonized.

15 Claims, 1 Drawing Sheet

APPARATUS AND PROCESS FOR CRIMPING AND CROSSLINKING FIBERS

FIELD OF THE INVENTION

The present invention relates to an apparatus and process for providing crosslinked fibers with non-symmetrical crimps. More particularly, there is provided an apparatus and process for crimping crosslinked fibers of tows of fibers which act as if they were crosslinked wherein the crimps are set by further heat treatment.

BACKGROUND OF THE INVENTION

Crimp can be defined as the non-linearity in fiber. For most of the man-made fibers employed in carpet manufacture, a non-woven battings, the crimp or bend in the fiber is induced by thermal/mechanical techniques. It can also be thought of as the difference between the non-linear (crimped) fiber and the straightened fiber (fiber extended). A crimp is important in carpet fibers and non-woven applications because it provides bulk to the yarn by preventing two fibers from laying parallel to one another. As a result, the carpet tuft will have greater covering power, appear softer, and give better resistance to wear and abrasion, among other benefits.

Crimp is also useful in the processing of staple fibers. Crimp is particularly useful in the processing of high modulus fibers which are difficult to work with because of slipperiness.

It is standard practice to crimp staple fibers such as polyester, acrylic, and nylon with steam and a stuffing box to provide pressure to result in a fiber which has waves or kinks in it. This crimp makes the fiber process better in nonwoven textile processes such as carding and permits the staple fiber to form high loft (low density) battings. This crimp is necessary for efficient processing of these fibers to spun yarns since the crimp is again necessary for efficient carding necessary for many forms of yarn making. The crimp also provides a means of further entangling the fibers and making a stronger yarn. From an overall textile point of view, crimp is important. However, textile fibers are thermoplastic and therefore the crimp comes out if the fibers are heated above their glass transition point. For instance, crimped continuous tow PAN fiber(acrylic) when heated to 210°-250° C. while undergoing preoxidation for the manufacture of OPF (oxidized polyacrylonitrile fiber) totally loses its crimp while being pulled through the oven.

Thermoset fibers such as carbon fibers and related fibers although relatively uncommon do not crimp since they do not soften or melt. Heat, steam, and pressure do not create crimp in carbon fiber, carbonaceous fibers (>65% carbon) or any other thermoset fiber.

Crimp in the stuffer box is achieved by passing yarn(s) or tow(s) into a uniformly heated chamber which is at the temperature required to heat set the fibers in their crimped or non-linear configuration. Steam is usually used to assist and lubricate. As the yarns are forced into the chamber by feed rolls, it pushes against yarn which is already in the chamber, thereby causing the filaments to bend and buckle (crimp).

A weight tube fitted into the top of the stuffer box governs the flow and quantity of yarn into the stuffer box. The frequency (crimps per inch) and the crimp amplitude of the fibers are controlled by regulating the speed of the feed rolls to that of the take up rolls as well as the weight of the tube. Crimp setting by these techniques can be done for single filaments or on multiple ends (tow) using the spunize technique. The crimps are generally characterized by numerous sharp bends.

U.S. Pat. No. 4,868,038 of McCullough et al, which is herein incorporated by reference, discloses one method for preparing novel non-linear carbonaceous fibers having physical characteristics resulting from heat treating stabilized polymeric fibers in the form of a knitted fabric. There is described a process wherein the fabric is substantially irreversible heat set under conditions free of non-uniform stress and tension. In order to obtain fibers which are non-linear, it is necessary to deknit the continuous fibers and then chopping to the desired length. Knitting and then deknitting the fabric to obtain non-linear carbonaceous fibers increases the cost in producing the fibers. This crimp is permanent and will not disappear on subsequent heat treatments.

Robinson U.S. Pat. No. 2,245,874, discloses a method for forming curled fiber material by passing fibers over rollers under conditions to bend and stretch the fibers beyond elastic limits. Such a process cannot be used to produce the non-linear fibers of the invention. This crimp can be removed by heating the fiber crimped up to the glass transition point.

Hemmi U.S. Pat. No. 2,623,266 discloses the mechanical preparation of sinusoid or spiraloid crimped fibers. The fibers are heated and passed through a series of bars which impart a meander-like crimp. However, the fibers are formed in a crimped and stretched state. It is desirable to provide a relatively inexpensive and simple method for producing non-linear fibers and tows.

It is further desirable to provide a method for producing non-linear fibers which does not require the prior formation of a fabric.

It is also desirable to prepare a non-linear carbonaceous fibers without performing a knit-deknit operation.

SUMMARY OF THE INVENTION

The present invention is directed to a process and an apparatus for forming non-symmetrical substantially permanent heat set crimps in crosslinkable fibers or tows which are capable of further crosslinking at elevated temperatures. The process of the invention comprises the steps of:

a) heating a precursor fiber or tow capable of being further crosslinked by heating at elevated temperatures so as to soften said fiber or tow;
b) horizontally feeding said heated fiber or tow into a horizontally crimper stuffer box so as to form a non-symmetrical crimp on said fiber or tow;
c) providing a pressure on said fiber or tow in said crimper stuffer box of about 10 to 50 kg to impart a crimp;
d) conveying said crimped fiber or tow from said crimper stuffer box without tension, and then
e) heat treating said crimped fiber or tow without tension so as to form substantially permanent crimps and a carbonaceous fiber or tow.

This process can be used with any fiber which will undergo some crosslinking by heat treatment.

The process of the invention is particularly useful for crimping partially crosslinked fibers, such as oxidized polyacrylonitrile fibers, or those fibers which act as though crosslinked, such as p-aramid fibers, which are liquid crystals or have a higher melt point.

The apparatus of the invention comprises:

a) means for heating a precursor fiber or tow capable of being further crosslinked by heat;
b) roll means adjacent said heating means of part a) for feeding said fiber or tow to a crimper stuffer box;
c) a horizontal crimper stuffer box adjacent the roll means for imparting a non-symmetrical crimp, said crimper stuffer box comprising a fixed doctor blade and a movable doctor blade, the movable doctor blade having means for applying pressure to the blade to cause a pressure on the fiber or tow while in a folded position;
d) means for heating the fiber or tow from the stuffer crimper box in an inert atmosphere, and
e) conveying means for conveying the fiber or tow from the crimper stuffer box to the heating means of part d) without stress or tension.

It is therefore an object of the invention to provide a process and apparatus for providing crosslinked fibers with non-symmetrical crimps. This crimp is permanent and subsequent heat treatment or other treatment will not remove it.

It is another object of the invention to provide a quick and economical process for forming crimped carbonaceous fibers or tows.

It is another object of the invention to provide an electrically conductive carbonaceous fiber suitable for electromagnetic interference (EMI) shielding.

Other objects and a fuller understanding of the invention will be had by referring to the following description of the preferred embodiments taken in conjunction with the accompanying drawing.

DESCRIPTION OF THE PREFERRED EMBODIMENTS

Figure 1:
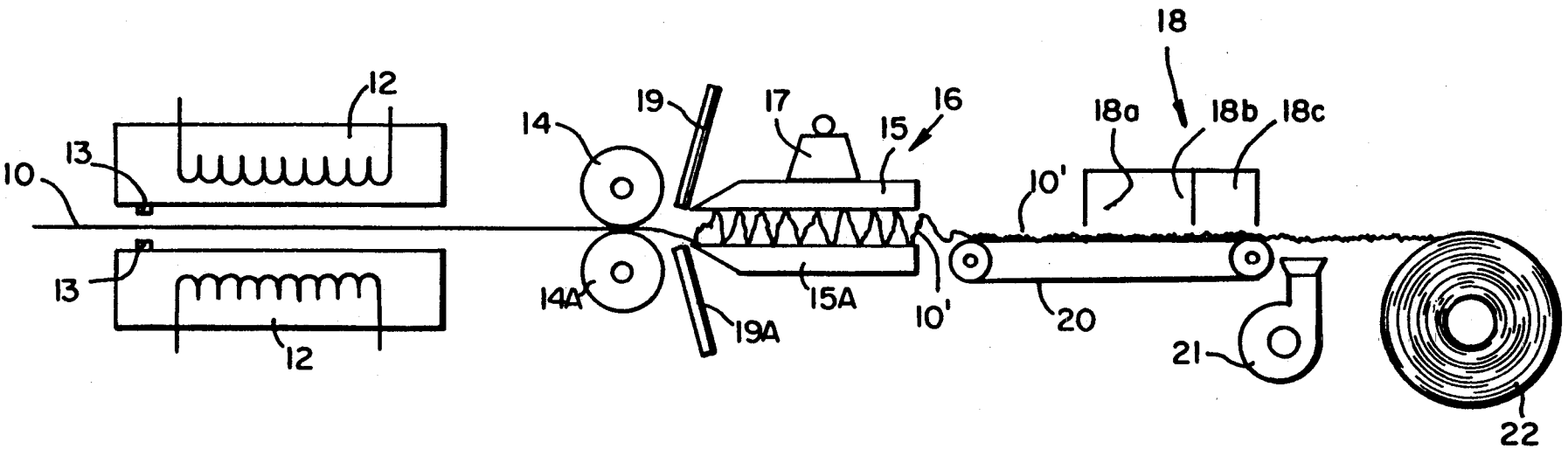
FIG. 1 schematically illustrates the apparatus and process of the invention.

Although specific terms are used in the following description for the sake of clarity, these terms are intended to refer only to the particular structure of the invention selected for illustration in the drawing and are not intended to define or limit the scope of the invention.

As seen in FIG. 1, a tow 10 of precursor fibers is first past through a heater 12 to soften the fibers. Advantageously, the heater 12 is provided with steam jets 13 which are used when the tow comprises oxidized polyacrylonitrile based fibers. The heated fiber 10 is fed into a crimper stuffer box 16 with feed or draw-in rolls 14, 14A. The feed rolls 14, 14A are preferably heated such as with steam to maintain the fibers in a softened state when fed into the crimper stuffer box 16.

The crimper stuffer box 16 is provided with a pair of doctor blades 15, 15A which function to feed the tow into the crimper stuffer box 16 and to apply pressure to the fibers. The pressure is applied by having one of the blades 15, 15A being hinged and acting as a clapper bar. The pressure can be applied with spring means, weights 17, as shown in the drawing, or any suitable means. A pressure of about 10 to 50 kg has been found to provide a suitable crimp for oxidized polyacrylonitrile fibers. Crimp in the tow is formed in the crimper box 16 at the tangent point of the rolls 14, 14A. The collection of the tow 10 in the crimper box 16 causes a back pressure to develop whereby the tow 10 forms a crimp. The width and depth of the crimper box 16 influences the type of crimp. Steam from jets 19, 19A applied before and during crimping also has an effect on the amount of crimp set.

Following the crimper box 16 there is provided a conveyor 20 which catches the crimped tow 10' from the crimper box 16 and delivers it without tension or stress to a oven 18 having a plurality of heating zones **18*a*, 18*b*, 18*c*. The first heating zone 18*a* is primarily to dewater the tow 10'. The other zones 18*b*, 18*c* are used to heat treat the crimped tow 10' in an inert atmosphere so as to heat set and/or carbonize the tow 10'**.

The tow 10' from the heater 18 is preferably cooled by a blower 21 before take-up on the take-up roll 22 which is synchronized with the conveyor speed to prevent tension or stress on the fiber.

In the case where the fiber or tow comprises stabilized or oxidized polyacrylonitrile fibers and heat setting is to be effected, the oxidized fibers are heated to temperatures of 300° to 1400° C. in a non-oxidizing atmosphere such as nitrogen, argon or helium. The carbonizing zone may be a single or multigradient furnace comprising a number of heating zones. The inert gases can be supplied through the opening of the heating zone or may be injected at various points along the way of the fiber path.

Polymeric precursor material for the stabilized polyacrylonitrile fibers and tows which are advantageously utilized in preparing the carbonaceous fibers of the invention are selected from one or more of the following: acrylonitrile homopolymers, acrylonitrile copolymers and acrylonitrile terpolymers. The copolymers preferably contain at least about 85 mole percent of acrylonitrile units and up to 15 mole percent of one or more monovinyl units of styrene, methyl acrylate, methyl methacrylate, vinyl acetate, vinyl chloride, vinylidene chloride, vinyl pyridine and the like copolymerized therewith. The acrylic filaments can also comprise terpolymers wherein the acrylonitrile units are at least about 85 mole percent.

In the case of polyacrylonitrile based fibers, the fibers can be formed by conventional methods such as in U.S. Pat. No. 4,837,706 by melt, dry or wet spinning a suitable liquid of the precursor material. The polyacrylonitrile (PAN) based fibers which have a normal nominal diameter of from 4 to 25 micrometers are collected as an assembly of a multiplicity of continuous filaments in tows. The fibers are than stabilized, for example by oxidation or any other conventional method of stabilization. The stabilization fibers or tows which are typically made from chopped or stretch broken fiber staple are processed according to the invention and heat treated at elevated temperatures in an inert non-oxidizing atmosphere for a period of time to produce a heat induced thermoset reaction. Typically, nitrogen content for the fiber of between about 5 to 35% is maintained. At a temperature range of from 150° C. to 525° C. and above, the fibers are generally provided with a substantially permanent or irreversible heat set.

As a result of the higher temperature treatment of 525° C. and above, a more permanent or irreversible crimp is imparted to the fibers or tows. The resulting tows or fibers may be used per se.

The carbonaceous fibers derived from oxidized polyacrylonitrile based materials which provided by the invention are classified into three groups.

In a first group, the carbonaceous fibers have a carbon content of greater than 65% but less than 85%, are electrically nonconductive, and do not possess any electrostatic dissipating characteristics, i.e., they are not able to dissipate an electrostatic charge.

The term electrically nonconductive as utilized in the present invention relates to a resistance of greater than $4\times10^6$ohms/cm($10^7$ohms/in) when measured on a 6K (6000 filaments) tow of individual fibers having a diameter of from 4 to 20 microns.

When the fiber is stabilized and heat set polyacrylonitrile based fiber, it has been found that a nitrogen content of about 18% or higher results in an electrically nonconductive fiber.

In a second group, the carbonaceous fibers are classified as being partially electrically conductive (i.e., having a low conductivity) and having a carbon content of greater than 65% but less than 85%. The percent nitrogen content of such fibers is generally 16 to 20%. Low conductivity means that a 6K tow of fibers in which the individual precursor fibers have a diameter of from 4 to 20 micrometer, has a resistance of from $4\times10^6$ to $4\times10^3$ ohms/cm ($10^7$–$10^4$ ohms/in).

In a third group are the fibers having a carbon content of at least 85 percent but less than 92% and a nitrogen content of at least 5%. These fibers are characterized as having a high electroconductivity. That is, the fibers have an electrical resistance when measured on a 6K tow of less than $4\times10^3$ ohms/cm ($10^4$ ohms/in).

The non-symmetrical electrically conductive carbonaceous fibers are useful in EMI shielding.

Para-aramids which are processed according to the invention need only be carbonaceous in an amount of about 0.5 to 5%, preferably, about 1 to 3% to obtain a substantially permanent crimp.

Specific examples of p-aramids which can be processed according to the invention include polyparabenzamide and polyparaphenylene terephthalamide. Polyparabenzamide and their processes of preparation are disclosed in U.S. Pat. Nos. 3,109,836, 3,225,011; 3,541,056; 3,542,719; 3,547,895; 3,558,571; 3,575,933; 3,600,350; 3,671,542; 3,699,085; 3,753,957; and 4,025,494. Polyparaphenylene terephthalamide (p-aramid) is available commercially as KEVLAR, a trademark of E.I. duPont de Nemours, and processes of preparing the same are disclosed in U.S. Pat. Nos. 3,063,966; 3,094,511; 3,232,910; 3,414,645; 3,673,143; 3,748,299; 3,836,498; 3,827,988, among Others. Other wholly aromatic polyamides are poly(2,7-phenanthridone)terephthalamide, poly(paraphenylene-2, 6-naphthalamide), poly(methyl-1,4-phenylene) terephthalamide. Additional specific examples of wholly aromatic polyamides are disclosed by P. W. Morgan in "Macromolecules," Vol. 10, No. 6, pp. 1381–90 (1977). The p-aramids fibers of the invention should be heat treated at a temperature above 200° C., preferably at a temperature of from 200° C., to 500° C., and more preferably from 200° C. to 375° C. The period of heating depends upon, the temperature, size of fiber, type of aromatic polyamide etc.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A process for forming non-symmetrical substantially permanent heat set crimps in crosslinkable fibers or tows which comprises the steps of;

a) heating and softening a precursor crosslinkable fiber or tow;

b) horizontally feeding said heated fiber or tow into a horizontal crimper stuffer box and forming a non-symmetrical crimp on said fiber or tow;

c) providing a pressure on said fiber or tow in said crimper stuffer box equivalent to of about 10 to 50 kg mass;

d) tensionlessly conveying said fiber or tow from said crimper stuffer box, and then, e) heat treating at a temperature above 300° C. in an inert atmosphere said tensionless crimped fiber or tow forming substantially permanent crimps and carbonaceous fiber or tow.

2. The process of claim 1 wherein said precursor fiber or tow is heated with steam in step a).

3. The process of claim 1 wherein said fiber or tow in step b) is fed into said crimper stuffer box by a pair of heated rolls.

4. The process of claim 1 wherein said fiber or tow comprises oxidized polyacrylonitrile based fiber or tow.

5. The process of claim 1 wherein said precursor fiber or tow comprises a p-aramid.

6. The process of claim 1 wherein the heat treatment of step e) comprises heat treating said fiber in separate heat treatment zones including a step of dewatering.

7. An apparatus for forming non-symmetrical crimps in a crosslinked fiber or tow and then forming a carbonaceous fiber or tow having substantially permanent heat set crimps without stress or tension, comprising a) means for heating a precursor fiber or tow capable of being further crosslinked;

b) roll means adjacent said heating means of part a) for feeding said fiber or tow to a crimper stuffer box;

c) a horizontal crimper stuffer box adjacent said roll means for receiving said fiber or tow from said roll means and imparting a non-symmetrical crimp, said crimper stuffer box comprising a fixed doctor blade and a moveable doctor blade, said moveable doctor blade having means for applying pressure to said moveable blade to cause a pressure on said fiber or tow while in a folded position;

d) means for heating the fiber or tow from said crimper stuffer box at a temperature above 300° C. in an inert atmosphere, and e) conveying means for conveying said fiber or tow from the crimper stuffer box to said heating means of part d) without stress or tension.

8. The apparatus of claim 7 wherein said heating means of part d) comprises a plurality of heating zones.

9. The apparatus of claim 8 wherein one of said heating zones includes means for providing an inert gas.

10. The apparatus of claim 7 wherein said heating means of part a) contains a means for providing steam.

11. The apparatus of claim 7 wherein said conveying means of part e) has a planar surface and conveys the fiber or tow through said heating means of part d).

12. The apparatus of claim 7 wherein said roll means of part b) is heated.

13. The apparatus of claim 7 including means for taking up said fiber or tow from said heating means of part d).

14. The apparatus of claim 7 wherein said crimper stuffer box comprises an upper moveable doctor blade and a lower fixed doctor blade and said upper doctor blade is provided with means for providing a pressure equivalent to about a 50 kg mass on the fiber or tow in said crimper stuffer box.

15. The apparatus of claim 7 wherein said stuffer crimper box contains a means for providing steam.

* * * * *